United States Patent [19]

Takabatake

[11] Patent Number: 4,920,616

[45] Date of Patent: May 1, 1990

[54] SLIDER FOR A SLIDE FASTENER

[75] Inventor: Hideo Takabatake, Namerikawa, Japan

[73] Assignee: Yoshida Kogyo K.K., Tokyo, Japan

[21] Appl. No.: 288,567

[22] Filed: Dec. 22, 1988

[51] Int. Cl.[5] ..... A44B 19/30

[52] U.S. Cl. ..... 24/418; 24/401; 24/433

[58] Field of Search ..... 24/418, 433, 435

[56] References Cited

U.S. PATENT DOCUMENTS

| | | | |
|---|---|---|---|
| 1,853,634 | 4/1932 | Norton | 24/418 |
| 1,890,336 | 12/1932 | Nodine | 24/418 |
| 2,186,809 | 1/1940 | Pindek | 24/418 |
| 2,279,767 | 4/1942 | Ulrich | 24/418 |
| 2,591,948 | 4/1952 | Lawson | 24/418 |
| 3,226,788 | 1/1966 | Samberg et al. | 24/418 |
| 3,449,803 | 6/1969 | Manning | 24/418 |
| 3,798,714 | 3/1974 | Mueller . | |

FOREIGN PATENT DOCUMENTS

| | | | |
|---|---|---|---|
| 0600764 | 7/1934 | Fed. Rep. of Germany | 24/418 |
| 0439578 | 12/1935 | United Kingdom | 24/418 |

*Primary Examiner*—Victor N. Sakran

*Attorney, Agent, or Firm*—Hill, Van Santen, Steadman & Simpson

[57] ABSTRACT

A slider for use with a ladder-type slide fastener is disclosed which comprises a pair of opposed flanges and means of locking the slider in place against unintentional movement under the influence of a force tending to spread open the fastener. The locking means comprises a locking lug extending from either one of the flanges and adjacent first and second locking projections extending from either one of the flanges opposite to the locking lug, the first and second locking projections being spaced one element pitch apart such that the locking action is effected at either of the two projections in the event that the fastener coupling elements in one row are shifted out of the normal pitch relation to those in the other row.

6 Claims, 5 Drawing Sheets

SLIDER FOR A SLIDE FASTENER

BACKGROUND OF THE INVENTION

1. Field of the Invention:

This invention relates generally to slide fasteners and more particularly to a slider therefor.

2. Prior Art:

Numerous types of sliders for opening and closing the slide fasteners have been proposed which are provided with means for locking the slider in position against unintentional movement subject to a force tending to spread or open the fastener. One such locking means was formed on a pull tab attached to and adapted to facilitate movement of the slider body. For slide fasteners, however, having ladder-type or meandering coupling elements in two rows, one on the upper and the other on the lower side of the fastener, the locking means was preferably provided on or in connection with the flange portion of the slider body. A slider with the latter type of locking means was disclosed in U.S. Pat. No. 3,798,714 in which the slider (as shown in FIG. 6) has a pair of locking tabs or projections 100 and 101, one of upper opposed flanges 102 on an upper wing member and the other tab or projection on a corresponding extreme end of one of lower opposed flanges 103 on a lower wing member, the locking tabs 100 and 102 engageable with the heel portions 104 of the coupling elements E respectively on the upper and lower sides of the fastener to prevent spontaneous spreading-apart action of the confronting stringers. Whilst this prior flange-lock slider has its own advantages, it has a drawback in that either one of the pair of locking tabs would fail to lockably engage with the heel portion of the coupling element in the event that the opposed stringers are coupled together with the coupling elements in one row misaligned with respect to those in the other row; that is when the elements on one stringer are interengaged with their counterparts on the other stringer with one element pitch shifted out of position either in the opening or the closing direction of the fastener, or stated otherwise when the coupling elements on the right side are disposed half an element pitch out of alignment with respect to those on the left side as visualized in FIG. 6, in which instance only one of the two locking tabs engages with the heel portion of the element, while the other tab does not because the element to be arrested thereby is displaced half a pitch from the normal position. Thus, such one-sided locking action would not be effective when the fastener is subjected to a lateral pull or force applied to spread its stringers apart.

SUMMARY OF THE INVENTION

With the foregoing drawbacks of the prior art in view, the present invention seeks to provide an improved slider for slide fastener which has means of locking the slider positively in place against unintentional movement under the influence of a force tending to spread open the fastener.

More specifically, the invention seeks to provide an improved slider for a ladder-type or meandering-element slide fastener which has a dual locking means capable of retaining the slider in locked position even when a row of coupling elements on one stringer is displaced or shifted out of the normal pitch relation to an opposite row of elements on the other stringer.

Other features and advantages of the invention will be apparent from the following detailed description taken in connection with the accompanying drawings which illustrate by way of example some preferred embodiments which the invention assume in practice.

According to the invention, there is provided a slider for a slide fastener of the type comprising a pair of oppositely disposed stringers each carrying a row of ladder-like or meandering coupling elements, each of which elements has a head portion and a heel portion, the slider comprising upper and lower wing members spaced in parallel and joined together at their one or front ends by a connecting post, a pair of opposed lateral flanges extending from each of the wing members and inwardly directed to define with the wing members a substantially Y-shaped guide channel for the passage of the stringers, and means of locking the slider in place against inadvertent movement comprising a locking lug extending from one end of at least either one of the upper and lower flanges, a first locking projection extending from one end of at least either one of the upper and lower flanges opposite to the locking lug and a second locking projection spaced one element pitch apart from the first locking projection.

DETAILED DESCRIPTION OF THE INVENTION

Figure 1:
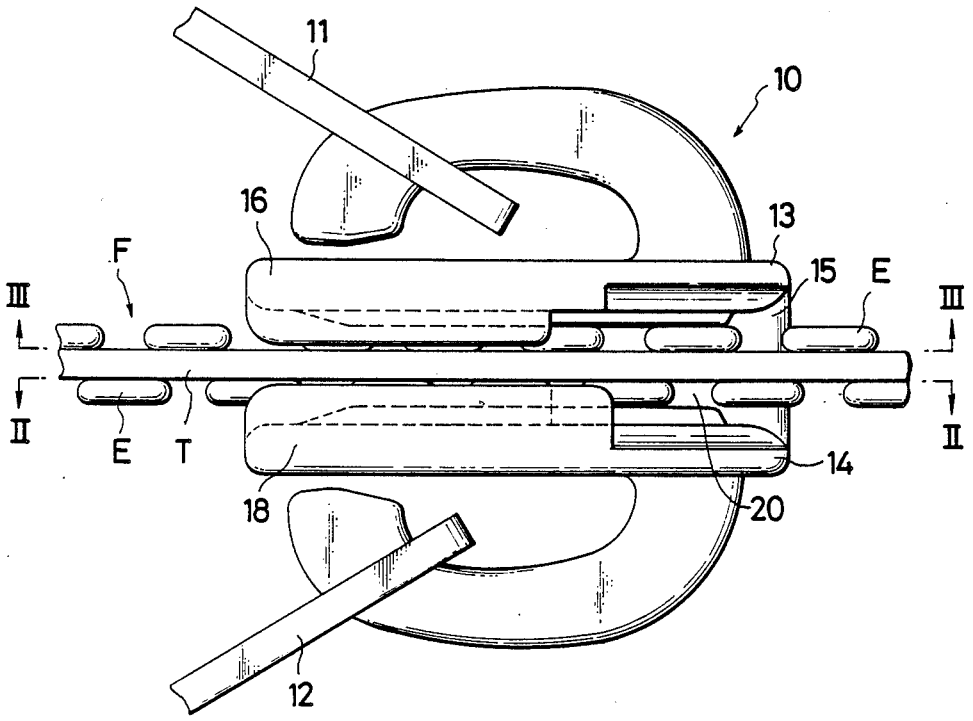
FIG. 1 is a fragmentary side elevational view on enlarged scale of a double pull tab slider embodying the invention.

Referring now to the accompanying drawings and FIG. 1 in particular, there is shown a slider generally designated 10 which is mounted on a ladder-type slide fastener F comprising a pair of oppositely disposed support tapes T each carrying a row of meandering or zig-zag coupling elements E, the tape together with the coupling elements constituting what is commonly termed a stringer. The slider 10 has two pull tabs 11, 12 pivotally mounted on its upper and lower surfaces, respectively, so as to enable movement of the slider conveniently from either side of the fastener F.

The slider 10 comprises an upper plate or wing member 13 and a lower wing member 14 which are spaced in parallel and joined together at their one or upper ends (as viewed in FIGS. 2–4) by a connecting post 15 commonly known as a "diamond". The upper and lower wing members 13, 14 each have lateral side flanges 16, 17 and 18, 19 respectively, which are inwardly directed to define together with their wings and the post 15 a substantially Y-shaped guide channel 20 for the passage therethrough of the fastener stringers.

Figure 3:
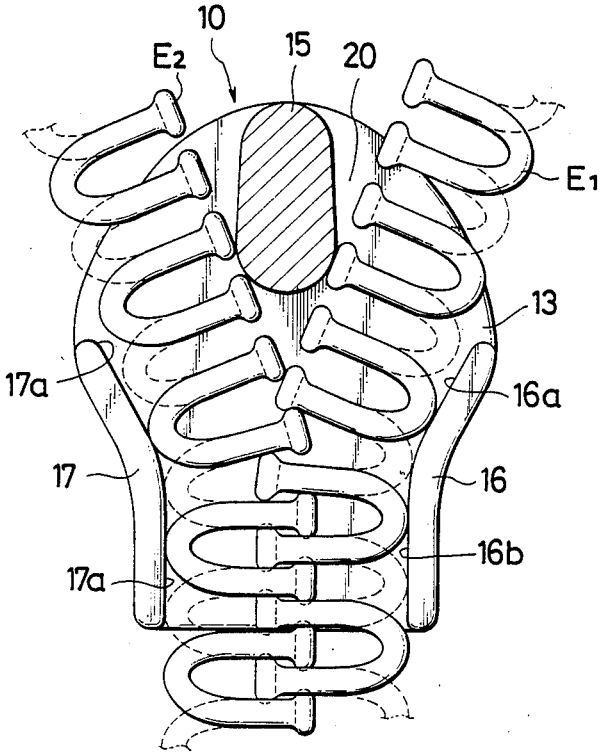
FIG. 3 is an enlarged sectional view taken on the line III—III of FIG. 1 with fastener tapes removed.

FIG. 3 shows the upper wing member 13 as viewed from its interior, from which it will be seen that the coupling elements E in opposed rows on their support tapes (not shown) are separated as they move past the post 15 upwardly or in a direction to open the fastener F and become interengaged as they are drawn into the guide channel 20 or moved downwardly or in a direction to close the fastener F. To facilitate this alternative movement of the coupling elements E relative to the slider 10, the flanges 16, 17 (18, 19) are flared upwardly or toward the post 15 to provide outwardly curved inner abutment walls 16*a*, 17*a* (18*a*, 19*a*) for smooth progressive sliding contact with the heel portions E1 of the coupling elements E while the head portions E2 thereof on one support tape are brought into or out of engagement with those on the other mating tape as is well known. Straight inner abutment walls 16*b*, 17*b* (18*b*, 19*b*) are formed contiguous with the curved walls 16*a*, 17*a* and adapted, is well known, to orient and maintain the opposed rows of elements E in fully interengaged position.

A locking means is provided for locking the slider in place against inadvertent movement which would otherwise occur under the influence of a force tending to spread apart the halves of the fastener F, the locking means comprising a locking lug 21 formed on the upper end of one of the opposed flanges 18 of the lower wing member 14, a first locking projection 22 formed on the upper end of the other flange 19 and a second locking projection 23 spaced from the first projection 22 by a distance substantially corresponding to one element-to-element pitch P. The locking lug 21, first end locking projections 22 and 23 are all inwardly directed toward the channel 20 to arrest the coupling elements E and lock the slider 10 in place and have flat abutment surfaces 21*a*, 22*a* and 23*a*, respectively, these surfaces being substantially parallel with the longitudinal axis of the slider or with the direction of linear movement of the interengaged rows of elements to allow contact with the heel portions El of the coupling elements with minimum of friction.

The first projection 22 on the flange 19 is registered in position with locking lug 21 on the confronting flange 18, but is reduced in width to provide space for the formation of the second projection 23 which lies substantially one pitch P apart from the first projection 22 for purposes hereafter described.

Figure 2:
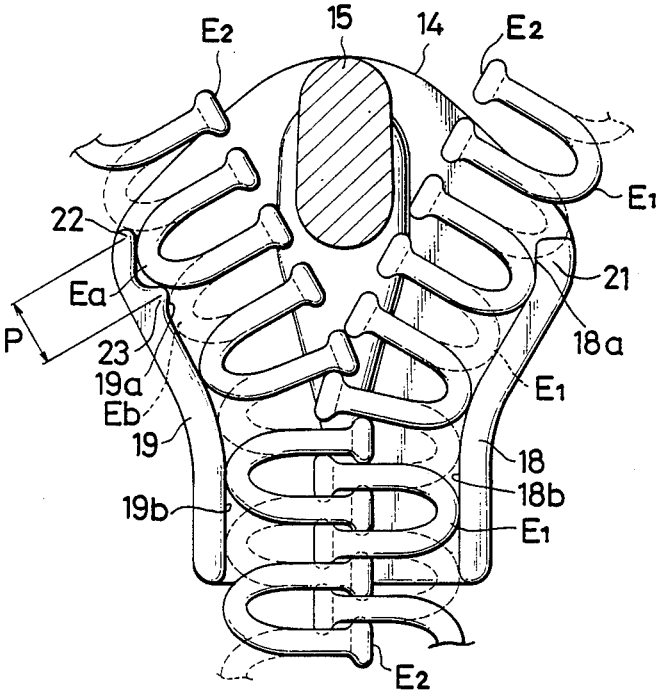
FIG. 2 is an enlarged sectional view taken on the line II—II of FIG. 1 with fastener tapes removed and showing one mode of locking action.
Figure 4:
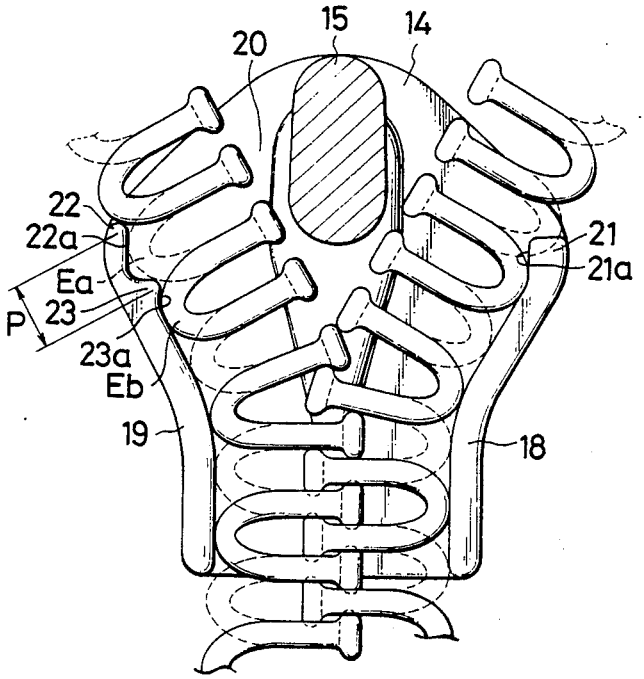
FIG. 4 is a view similar to FIG. 2 but is utilized to explain another mode of locking action.

In operation, the slider 10 with the fastener F applied to a garment article will automatically lock itself against inadvertent movement by the cooperative action of the locking lug 21 and the first and second locking projections 22 and 23, in which the lug 21 arrests the coupling element E on one stringer close at the leading end of its heel portion El, while the first projection 22 similarly arrests the coupling element E on the other stringer as shown in FIG. 2 where there is no disruption in the normal pitch relation between the two opposed rows of elements E. In the event however that the coupling elements E in the respective rows are shifted out of the normal pitch relation, the particular element Ea on one stringer, which would otherwise be located with its heel portion El at the first locking projection 22, becomes displaced so that no locking action takes place thereat, while the corresponding element E on the other stringer is arrested by the locking lug 21, in which instance the ensuing element Eb is arranged to come into contact with the second locking projection 23 as shown in FIG. 4, thus establishing effective positive lock of the slider 10.

The flanges 16, 17 of the upper wing member 13 are reduced in their overall length with a view to preserving aethetically attractive front surface appearance of the slider 10.

Various changes and modifications may be made in the specific form and construction hereinabove advanced, without departing from the scope of the appended claims.

Figure 5A:
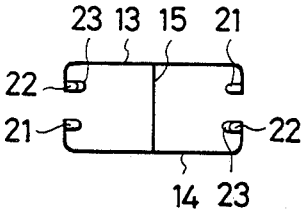
FIGS. 5*a* and 5*b* each are a diagrammatic view showing alternative positions of locking means according to the invention.
Figure 5B:
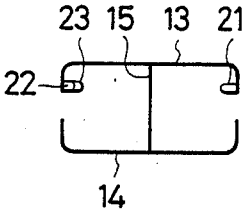
Figure 6:
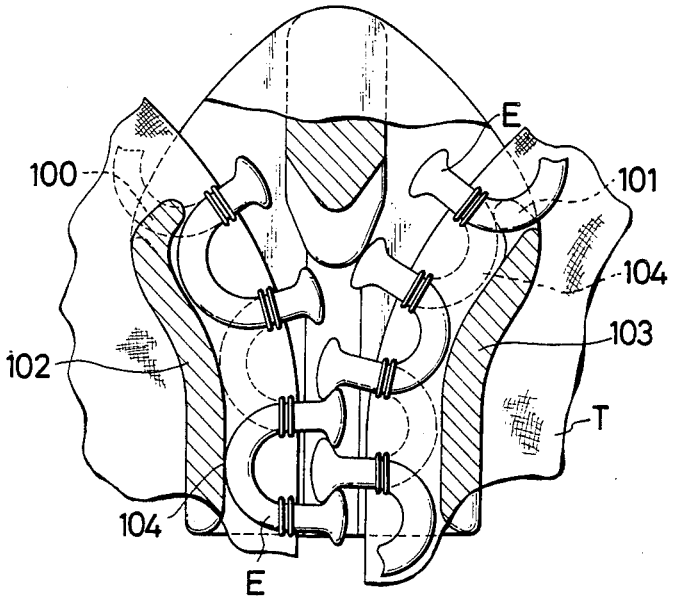
FIG. 6 PRIOR ART
FIG. 6 is a fragmentary sectional view similar to FIG. 2 but of a prior art slider.

For example, the locking lugs 21, first and second projections 22 and 23 may be provided at both upper and lower flanges of the slider 10 in different locations as shown in FIG. 5*a*, or alternatively they may be provided only at the upper flanges as shown in FIG. 5*b*.

What is claimed is:

1. A slider for a slide fastener of the type comprising a pair of oppositely disposed stringers each carrying a row of ladder-like or meandering coupling elements, each of which elements has a head portion and a heel portion, said slider comprising upper and lower wing members spaced in parallel and joined together at their one or front ends by a connecting post, a pair of opposed lateral flanges extending from each of said wing members and inwardly directed to define with said wing members a substantially Y-shaped guide channel for the passage of said stringers, and means of locking the slider in place against inadvertent movement comprising a locking lug extending from one end of at least either one of said upper and lower flanges and adapted to arrest one of the heel portions of said elements on one of said stringers when a stress is applied to spread apart the stringers, a first locking projection extending from one end of the opposite flange and adapted to arrest one of the heel portions of said elements on the other stringer when a stress is applied to spread apart said stringers and a second locking projection on said opposite flange positioned one element pitch apart from said first locking projection such that when said first locking projection fails to arrest any one of said heel portions, said second locking projection positively arrests the next succeeding heel.

2. A slider as claimed in claim 1 wherein each of said locking lug and said first and second locking projections has an inner surface lying substantially parallel with the longitudinal axis of the slider.

3. A slider as claimed in claim 1 wherein said first locking projection is reduced in width to provide space for the formation of said second locking projection.

4. A slider as claimed in claim 1 including a pair of pull tabs mounted on said upper and lower wing members to facilitate movement of the slider from either side of the fastener.

5. A slider as claimed in claim 1 wherein said first and second locking projections each are arranged to arrest the coupling element at the leading end of its heel portion.

6. A slider as claimed in claim 1 wherein the pair of flanges on said upper wing member are shorter in length than that on said lower wing member.

* * * * *